United States Patent [19]

Gunn et al.

[11] 3,948,138

[45] Apr. 6, 1976

[54] VIBRATING STRING-MODULATED ELECTRONIC MUSICAL INSTRUMENT

[76] Inventors: Gary J. Gunn, 2121 Taylor St., San Francisco, Calif. 94133; Richard B. Hodges, 2313 Jefferson St., Berkeley, Calif. 94703; Leonard A. Schmidt, 7701 Errol Drive, El Cerrito, Calif. 94530

[22] Filed: Apr. 28, 1975

[21] Appl. No.: 572,072

Related U.S. Application Data

[63] Continuation-in-part of Ser. No. 346,474, March 30, 1973, abandoned.

[52] U.S. Cl. ..... 84/1.07; 84/1.1; 84/1.16; 84/1.27; 84/DIG. 8; 84/DIG. 24

[51] Int. Cl.[2] ..... G10H 1/02; G10H 5/02

[58] Field of Search... 84/1.01, 1.03, 1.04, 1.06–1.1, 84/1.14–1.17, 1.24, 1.27, DIG. 7, DIG. 8, DIG. 21, DIG. 22, DIG. 23, DIG. 24

[56] References Cited

UNITED STATES PATENTS

| | | | |
|---|---|---|---|
| 3,038,363 | 6/1962 | Miessner | 84/1.04 X |
| 3,388,206 | 6/1968 | Sines | 84/1.16 |
| 3,493,669 | 2/1970 | Elbrecht et al. | 84/1.16 |
| 3,530,226 | 9/1970 | Wheeler et al. | 84/1.16 |
| 3,530,227 | 9/1970 | Wheeler et al. | 84/1.16 |
| 3,594,487 | 7/1971 | Jones, Jr. | 84/1.1 |
| 3,666,875 | 5/1972 | Ranzato | 84/1.16 X |
| 3,673,304 | 6/1972 | Dudas | 84/1.01 |
| 3,733,953 | 5/1973 | Ferber | 84/1.16 |
| 3,786,167 | 1/1974 | Borell et al. | 84/1.16 |

*Primary Examiner*—L. T. Hix
*Assistant Examiner*—Stanley J. Witkowski
*Attorney, Agent, or Firm*—Warren, Chickering & Grunewald

[57] ABSTRACT

A musical instrument is disclosed which is constructed of a group of taut strings arranged to be strummed, each string being connected to operate an analog switch capable of producing a graduated signal that is directly proportional to the amplitude of vibration of its string, an extrinsic sound source in circuit with each analog switch, the sound source having a variable volume which is varied directly proportional to the strength of the signal from the analog switch, a number of switch means arranged in a keyboard, each of which may close the circuit to one or more preselected sound sources for which the switch means are closed and the strings are vibrating.

3 Claims, 4 Drawing Figures

VIBRATING STRING-MODULATED ELECTRONIC MUSICAL INSTRUMENT

CROSS-REFERENCE

This application is a continuation-in-part of our copending application Ser. No. 346,474, filed Mar. 30, 1973, and now abandoned.

BACKGROUND OF THE INVENTION

It is desirable to have a musical instrument that can be played skillfully without extensive practice or development of a high order of dexterity. Such instruments are particularly useful for vocal accompaniment where chords are all that is needed for inspiring an interest in music in students where the use of conventional instruments is discouraging because long hours of practice do not produce perceptible results. On a strummed instrument, such as a guitar, a great deal of skill and dexterity are needed to place the fingers properly for chords and to move them from one chord holding to another rapidly enough to keep time with the beat of the music.

Instruments such as Autoharps have been devised which provide a keyboard along with strummed strings. Chords can be held on an Autoharp without much difficulty because depressing a key actuates a mechanical device that damps a number of strings so that only those needed to produce that chord can be heard. Instruments such as Autoharps, however, must be tuned, and the tone quality available is limited by the structure of the instrument itself. Additionally, there are mechanical limits to how complex the chord can be.

Other instruments have been devised where the sound source is extrinsic to the instrument, and, accordingly, the quality of the tone is not dependent on the structure of the instrument itself. These instruments typically employ a keyboard which actuates an audio system that places the extrinsic sound source into the circuit only when its key is depressed. Extrinsic sound sources are known and are such things as synthesizers, continuous magnetic tapes where one tape is employed for each note and is recorded from a high quality instrument such as an organ or a piano or is produced by an oscillator that is not a musical instrument. Regardless of how good the quality of the extrinsic sound source may be, the music from such instruments characteristically sounds flat. The total volume of such instruments may be varied, but the decay of volume typical of the sound of a plucked string cannot be duplicated for each note in a chord, nor can chords be struck with some notes at higher volume than others. To duplicate these plucked string sounds by the use of volume control would require far more skill and dexterity than playing an instrument itself, if indeed it could be done at all.

SUMMARY OF THE INVENTION

This invention provides a musical instrument that can be played easily, that has an extrinsic source of sound that can be of any desired character or quality, and that produces the characteristic volume decay sound of a plucked string instrument. The musical instrument of this invention includes, in its broadest aspect, four cooperating elements and, in narrower aspects, more sophisticated additions to those elements which improve the utility or increase the scope of the instrument.

The first element of the broad invention is an array of taut strings arranged side-by-side to be strummed. The word "strum" is used in the sense of setting the strings vibrating by a single hand motion across the array, rather than in the sense of careless or unskilled use of the instrument. The strings are taut enough to vibrate as in other plucked string instruments, but they are not tuned in the sense that each must vibrate at exactly the frequency to produce its own unique pitch. The strings desirably are "tuned" in a respect that will be discussed hereinafter, but they are not precisely tuned to produce a particular pitch.

The second element of the broad invention is an analog switch associated with each string in a manner such that vibration of the string operates the switch. The term "analog switch" is used to define a device that is modulated by the amplitude of the vibrating string and is capable of producing a graduated electric signal that is directly proportional to the amplitude of vibration. The signal varies from zero to some maximum, although the analog switch is not characteristically used to block out sound. A typical analog switch and a preferred switch of this invention is a piezoelectric device wherein distortion of a piezoelectric crystal by a vibrating string produces a varying electric signal that varies proportional to the amplitude of vibration.

By way of example, other analog switches that may be employed are a photoelectric device that is inactive when in the shadow of a nonvibrating string but which is activated on a graduated basis by the intensity of light striking it as the light shines through a vibrating string. Other devices, such as magnetic pickups activated by the vibration of the string, may be employed as well as other devices for producing a graduated electric signal that are known to the art.

The third element of the broad invention is an extrinsic sound source having variable volume connected in circuit with each analog switch, such that stronger signals from the analog switch result in louder sound from the extrinsic sound source. The term "extrinsic sound source" means a sound source other than the vibrating strings themselves. In the instrument of this invention when a string is plucked, it vibrates, but the vibrating string is not heard. Rather, the vibrating string is employed to actuate the analog switch which in turn actuates the extrinsic sound source to make its sound audible at a volume proportional to the amplitude of string vibration.

Any suitable extrinsic sound source may be employed. The preferred sound source is a synthesizer such as those known to the art as mag synthesizers, although other sources such as a series of magnetic tapes each at a particular pitch and arranged to play through one or more common loud speaker systems may be used.

In this embodiment, each analog switch has one or more tapes with a unique tone associated with it, and they are arranged in a conventional scale. The extrinsic sound source may be a single oscillator or wave generator that can be programmed to produce waves characteristic of one or more notes, such as used in electric organs; or it may be a conventional musical instrument, such as an organ or a reed instrument that functions from a source of compressed air. It is evident that the extrinsic sound source may be selected to obtain any desired effect, and many new effects may be obtained through this invention, such as the tone of an organ or a brass instrument with the characteristic volume decay of a plucked string.

The fourth element of the broad invention is an array of switch means arranged in a keyboard and arranged so that each key may close a circuit to permit one or more audible sounds from one or more extrinsic sound sources, either as individual notes or as preselected chords. The term "switch means" is employed in its broadest sense in this disclosure and includes electronic devices such as binary memories which are better known as flip-flops or magnetic core storage devices. The function of the devices is to close appropriate circuits when the keyboard is operated. The term "keyboard" is also used in its generic sense and includes arrays of buttons as well as devices such as piano keys.

Although the musical instrument of this invention is not limited to any particular arrangement of strings or keys, a preferred embodiment of the invention is one in which the strings are arranged to be strummed with the right hand, and the keyboard is arranged to be operated with the left hand. To have an audible sound from an extrinsic sound source, it is necessary that the circuit for that sound source be closed by operation of the keyboard and that the string that activates that sound source be vibrating. If either of these elements is absent, there will be no sound. However, in the usual function of the musical instrument, all strings vibrate together as the instrument is strummed, and operation of the keyboard determines which sounds will be audible. The principle utility of the analog switches and the strings is not to prevent audible sound but to modulate it to give it character. Thus, vigorous strumming will be different from gentle strumming, but any strumming will produce the characteristic volume attack and decay of a plucked string regardless of the character of the sound from the extrinsic sound source.

DETAILED DESCRIPTION OF THE INVENTION

The invention described and claimed herein may be better understood with reference to the accompanying drawings which describe various embodiments of the invention and are intended to be illustrative rather than limiting on its broad scope.

Figure 1:
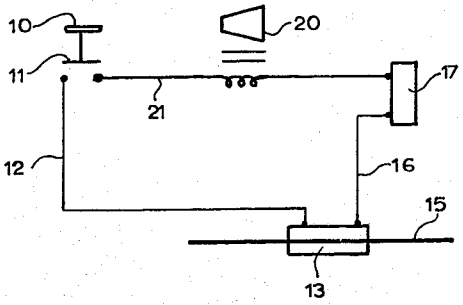
FIG. 1 is a schematic diagram of an arrangement of the four basic elements of this invention.

FIG. 1 illustrates, in highly schematic fashion, one arrangement for the four basic elements of the present invention. FIG. 1 illustrates a key 10 that operates a switch arrangement 11 such that depressing the key closes a circuit. The circuit includes conductor 12 that connects the key with analog switch 13 which in turn is operated by a string 15 that may be strummed or plucked to vibrate. The analog switch is also connected via conductor 16 to a source of extrinsic sound which includes a source of sound 17 and an audio device illustrated as loud speaker 20. The signal in line 16 as modulated by analog switch 13 will cause a sound to be emitted from loud speaker 20 that varies in volume proportional to the amplitude of vibration of string 15. The circuit is completed by conductor 21 returning to the switch mechanism 11.

It is evident from the diagram that, in order for sound to be heard from loud speaker 20, it is necessary that the switch mechanism 11 be closed to complete the circuit and that string 15 be vibrating so that a signal will be produced from analog switch 13. The circuit required for sound to be heard from loud speaker 20 depends mostly on whether switch 11 is open or closed. When switch 11 is closed, then sound can be heard only if the string is vibrating; and, in addition, the sound that is heard will be louder or softer depending upon the amplitude of the vibration of string 15.

As mentioned hereinabove, the strings 15 of the instrument of this invention do not have to be tuned precisely to produce the sound of a given pitch. Nevertheless it is desirable to "tune" the strings so that all of them will vibrate with approximately the same wave length so that all sounds modulated by the vibrating strings will have approximately the same volume decay character.

Each string should be tuned to best effect its function which, in this case, is to vibrate at about the same frequency and amplitude as all other strings when similarly plucked or strummed. It is therefore preferred that all strings be of the same diameter and made of the same material, that all strings be the same length, and that they all be strung with the same tension. To effect this, it is desirable to employ a torque wrench to tighten the strings or to employ with the instrument clutches that are set to slip at a certain torque whereby simply increasing the tension on each string through such a clutch mechanism will automatically place it at the same tension as all other strings.

Figure 2:
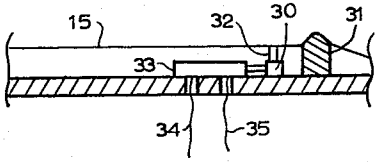
FIG. 2 is a partial view of a suitable arrangement of an analog switch for use in the device of this invention.

FIG. 2 illustrates schematically one suitable analog switch assembly that may be used in this invention. The switch illustrated in FIG. 2 is a piezoelectric crystal contained in a housing 30. The crystal is connected to a taut string 15 which is held, as in a guitar, by a bridge 31 and connected at both ends by conventional means which are not shown. A small actuating element 32 connects to or bears against string 15 so that vibration of the string causes a reciprocating motion of element 32. The reciprocating motion of element 32 is transmitted mechanically to activate a piezoelectric crystal in housing 30 which in turn acts through an analog modulator 33 to produce a varying electric signal in conductors 34 and 35. The degree of distortion of the crystal and, accordingly, the strength of the electric signal in conductors 34 and 35 is directly proportional to the amplitude of vibration of the string 15. Piezoelectric crystals in suitable housings are commercially available, and such conventional piezoelectric crystals may be employed in this invention. Analog modulator 33 is a conventional item which converts the varying signal from the piezoelectric crystal to one having more musically useful properties.

Figure 3:
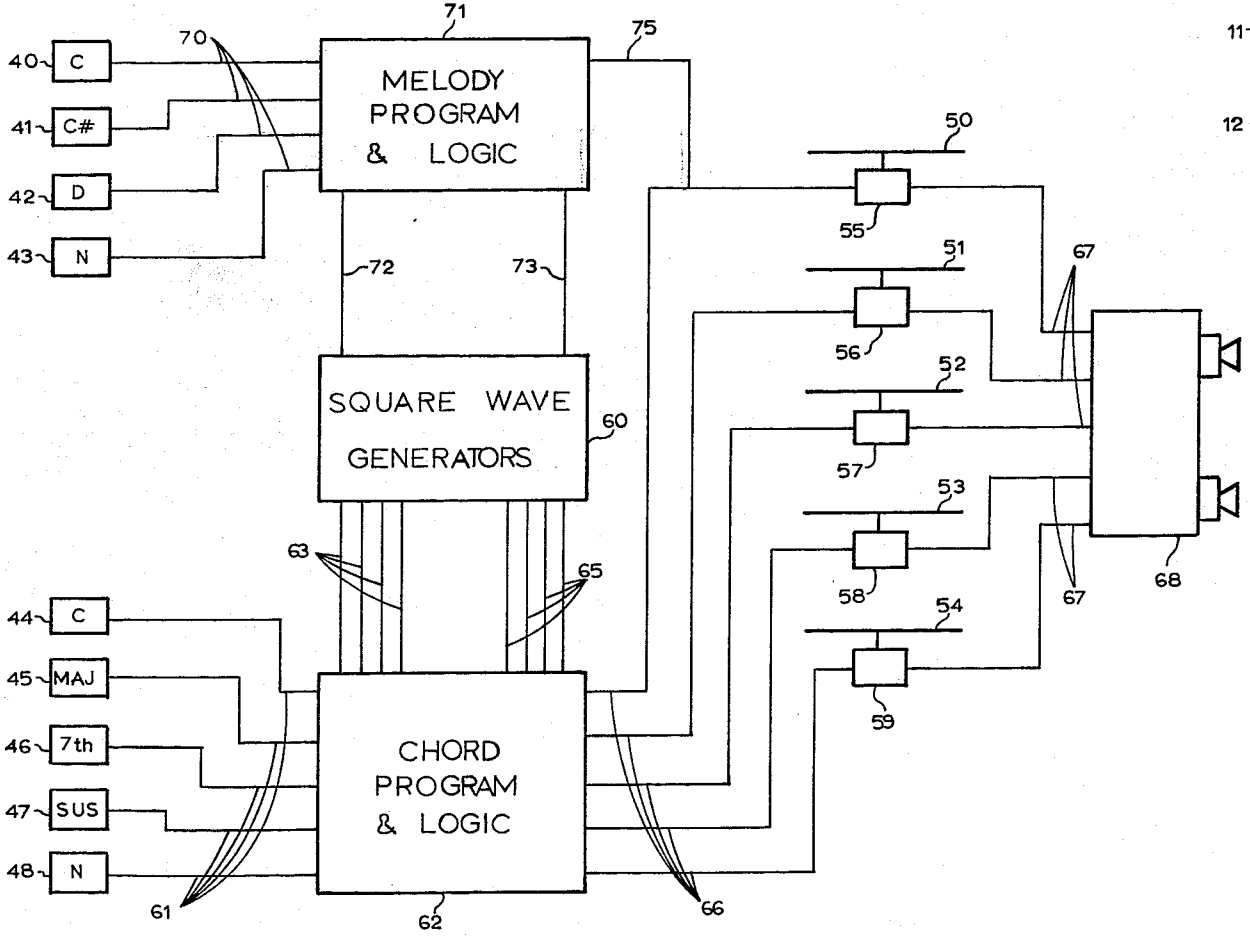
FIG. 3 is a schematic diagram of a more sophisticated embodiment of the invention than is shown in FIG. 1.

FIG. 3 illustrates a more sophisticated embodiment of the invention than the one illustrated in FIG. 1. The embodiment of FIG. 3 is illustrated schematically with the functional elements shown in their functional relationship rather than in any spatial relationship that would be employed. The device of FIG. 3 is capable of playing individual notes to produce melodies, or it is capable of playing chords. The device is operated by depressing one or more keys or buttons arranged in a keyboard and by strumming or plucking the strings.

The keyboard includes a number of buttons identified by reference numerals 40 to 48 inclusive. Some of the buttons are melody buttons; and, when these buttons are depressed while one or more strings are strummed, the instrument of this invention will cause individual notes to become audible. Thus, button 40 is identified as the note C while button 41 is the note C-sharp; button 42 is D and button 43 is *n* which is employed to illustrate a general note and refers to any melody note and any number of buttons. Although only four melody buttons are shown for purposes of illustration, many more are contemplated, and in fact there is no limit to the number that can be used. The melody keyboard may also include buttons to select octaves or for other purposes.

Some of the buttons on the keyboard are chord buttons which, when operated along with strumming the strings, cause chords to become audible. Thus, button 44 is depressed when a C chord is to become audible; button 45 is to produce a major chord; button 46 is to produce the 7th interval of the chord; button 47 is to produce a sustained chord; and button 48 is the nth button to represent many buttons and any of the plurality of others that may be used.

The device of this invention may have any number of strings and may be in the form of a console, a lap-held instrument such as an Autoharp, an instrument such as a guitar; or the instrument of this invention may be in a unique form. It is preferred that the instrument have at least four strings and less than thirteen strings. Generally, a guitar-like configuration of strings is preferred with five to eight strings being employed. For purposes of illustration, the instrument of FIG. 3 shows five strings numbered 50 through 54 inclusive. Strings 50 through 54 have analog switch assemblies, numbered 55 through 59 respectively, positioned and arranged to be operated by the vibration of the strings.

The device illustrated in FIG. 3 includes a square wave generator 60. The square wave generator, in combination with an audio system, is the extrinsic sound source for the device embodied in FIG. 3. The square wave generator 60 is a known device which is capable of generating square wave signals with predetermined frequencies. As will be discussed in more detail hereinbelow, square wave generator 60 operates in conjunction with known electronic components to program the square wave generator, to route the signals from the square wave generator to the analog switch assemblies of appropriate strings, and in a preferred embodiment to include a memory to maintain individual notes or chords audible until another button is pushed. The device illustrated in FIG. 3 functions as follows.

When it is desired to play a series of chords, the strings 50 through 54 are strummed; and the keyboard is operated. When the O button is depressed, a signal is transmitted through conductor 61 to the chord program and logic means 62. The chord program and logic means 62 may also include memory circuits to maintain the C chord programmed into the device when the C chord button is released until another button of the keyboard is pushed; and when the other keyboard button is pushed, the memory for the C chord is cancelled, and the memory is activated for the next button that is pushed.

The chord program and logic means 62 transmits through conductor 63 an appropriate signal to square wave generator 60 so that the square wave generator 60 will generate square wave signals at frequencies appropriate for those notes that are required to produce a C chord. The square wave signals are transmitted through conductors 65 back to the chord program and logic means 62, which in turn distributes those signals through conductors 66 to those analog switch assemblies which are operated by the strings that were predetermined to modulate the notes for the C chord. In a preferred form of the invention, each of the three tones of the C chord will be modulated by its own string, and selected higher octaves of the basic notes of the chord will also have individual strings to modulate them. However, it is possible to have one string modulate two notes simultaneously or even a whole chord.

Those analog switch assemblies which are employed to produce the C chord will modulate the intensity of the square wave signal proportional to the amplitude of vibration of those strings which are employed to operate the appropriate analog switch assemblies. By way of specific example, if the C chord is programmed so that vibration of strings 50, 52 and 54 modulate the sounds that produce that chord, then the square wave signals required for that chord are passed through those conductors 66 that will be connected to analog switch assemblies 55, 57 and 59. The square wave signals whose intensity is modulated by the analog switch assemblies are then passed through conductor 67 to an amplifier 68 to produce audible sounds. The amplifier assembly 68 may include filtering means and other means appropriate to producing a desirable sound. The sound that is heard will be a C chord having the characteristic volume attack and decay of a vibrating string.

The chord program and logic device 62 may also be programmed to produce the desirable number of divisions of the frequencies programmed for the chord so that each note employed in the C chord may be divided to produce a number of overtones.

Chord buttons may be depressed in combinations to produce particular results. For example, one may depress a button for a particular chord, a second button to select the major or minor key of that chord, and perhaps a third button to add the seventh interval of that chord. Generally, certain chords will be programmed to be either major or minor unless a major or minor key button is depressed to change the key. For example, the C chord will typically be played as C major so that depressing the C button alone will result in a C major chord. If a C minor chord is wanted, it will be necessary to depress both the C button and the minor key button. Effects such as adding the seventh or higher intervals or sustained chords will also be obtained by simultaneously depressing more than one button in the chord keyboard so that the chord program and logic means 62 may send appropriate instruction signals to the square wave generator 60.

To play melody on the device of this invention, a number of buttons may be provided which will, when depressed and one or more strings strummed, make individual notes audible. The program is similar to the one described for chords. For example, if button 42 is depressed, it will transmit a signal through one of conductors 70 to a melody program and logic means 71. The melody program and logic means 71 will transmit a signal to square wave generator 60 through conductor 72, which signal will instruct the square wave generator to produce a square wave having an appropriate frequency for the note D. This square wave frequency will be transmitted through conductor 73 back to melody program and logic means 71 and then transmitted through conductor 75 to that conductor 66 that is connected to analog switch assembly 55. The production of a sound modulated by a vibrating string is then the same as for the chord producing program described hereinabove. As illustrated, a melody may be played by plucking string 50 and operating appropriate melody buttons. As illustrated in FIG. 3, only one string is plucked to produce melody. It is evident that any string or all strings could be programmed for this purpose.

The invention described herein does not involve the manner in which the various elements of the combination operate. Devices and techniques are known to the art to supply the program logic means, square wave generator, analog switch means, and amplifier assemblies that are employed in the device illustrated in FIG. 3. The various conductors are not illustrated in the appropriate number, and all conductors may be multiple conductors in cables, coaxial conductors, or other forms known to the art.

Figure 4:
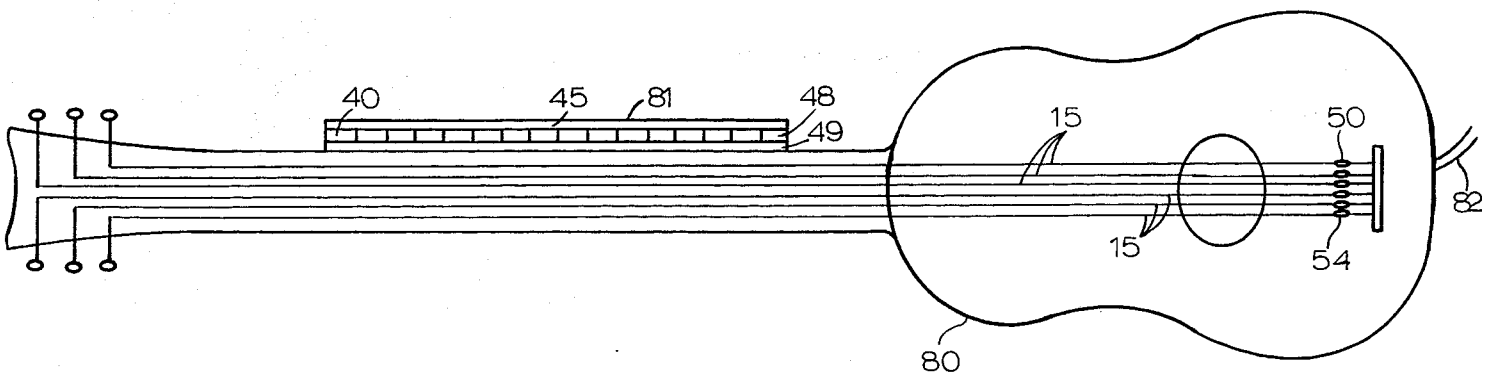
FIG. 4 is a plan view of a suitable form of an instrument embodying this invention.

FIG. 4 illustrates an instrument embodying this invention. The instrument is generally designated 80, and it is in the form of a guitar. The guitar has the usual guitar shape and includes six strings 15 which are held in tension by conventional means. Each string is positioned to operate an analog switch assembly. Six analog switch assemblies are illustrated, but only the first switch assembly 50 and the last switch assembly 54 are specifically identified. Each of the switch assemblies is identical to the others.

A keyboard generally designated 81 contains a number of buttons that are employed as described hereinabove. The number of buttons illustrated in FIG. 4 is not intended to suggest the number that would be employed in an instrument but are shown in one of many positions where they could be employed for purposes of illustration. Generally, the melody buttons, such as button 40, and the chord buttons, such as button 48, will be of a size and shape to be depressed like other instrument buttons, such as those used in typewriters. Preferably, the major key button 45 and a minor key button 49 will be elongated buttons so that they can be depressed simultaneously with any chord button using one finger. The instrument may be constructed with foreshortened strings 15 so that the keyboard can be directly on the fingerboard of the instrument. Frets are not necessary in the instrument of this invention because the strings 15 are not tuned to any particular pitch; however, they may be provided to change the volume decay rate or for cosmetic reasons if desired. The cable 82 will contain conductors 61 and conductor 70. In a preferred embodiment, the program and logic means, the square wave generator, and the amplifier assembly will be in at least one separate consold that is remote from the instrument 80 itself.

What is claimed is:

1. A musical instrument comprising:

A. a plurality of strings arranged to be strummed,

B. each string having an analog switch assembly which is activated by the vibration of that string to be modulated by the amplitude of the vibration of the string to produce a signal that varies directly in strength with the amplitude of vibration, C. a variable volume, extrinsic sound source means in circuit with each analog switch assembly, said sound source means providing a plurality of notes and having its volume modulated to vary directly with the strength of the signal from the analog switch assembly in circuit therewith and, D. a plurality of switch means arranged in a keyboard and connected so that the operation of a switch means will close a circuit which includes an extrinsic sound source means whereby said sound source means is made audible only when said switch means is closed and the string that activates its analog switch assembly is vibrating.

2. The instrument of claim 1 wherein all strings are the same material, substantially the same length, the same diameter, and under the same tension.

3. The instrument of claim 1 wherein said analog switch means includes a piezoelectric crystal.

* * * * *